US008585194B2

(12) United States Patent
Minamikawa et al.

(10) Patent No.: US 8,585,194 B2
(45) Date of Patent: Nov. 19, 2013

(54) CARTRIDGE AND PRINTING APPARATUS

(71) Applicant: Seiko Epson Corporation, Tokyo (JP)

(72) Inventors: Miho Minamikawa, Kitakatsushika-gun (JP); Hideki Ochiai, Kitakatsushika-gun (JP); Satoshi Gocho, Kitakatsushika-gun (JP); Yoshihiro Koizumi, Shiojiri (JP); Yoshihiro Nakamura, Matsumoto (JP); Akihito Matsumoto, Chino (JP); Takeshi Iwamuro, Matsumoto (JP); Nobumasa Fukushima, Okaya (JP); Masaru Takahashi, Matsumoto (JP); Takakazu Fukano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/632,269

(22) Filed: Oct. 1, 2012

(65) Prior Publication Data

US 2013/0083142 A1 Apr. 4, 2013

(30) Foreign Application Priority Data

Sep. 29, 2011 (JP) ..... 2011-213880

(51) Int. Cl.
*B41J 2/175* (2006.01)

(52) U.S. Cl.
USPC ..... 347/86

(58) Field of Classification Search
USPC ..... 347/85, 86, 87; 427/162, 163.1; 385/9, 385/130, 131
See application file for complete search history.

(56) References Cited

U.S. PATENT DOCUMENTS 6,952,504 B2 * 10/2005 Bi et al. ..... 385/9
7,656,084 B2 * 2/2010 Ishida ..... 313/504
8,206,779 B2 * 6/2012 Suzuki et al. ..... 427/162

FOREIGN PATENT DOCUMENTS

JP 2005-119228 A 5/2005

* cited by examiner

*Primary Examiner* — Anh T. N. Vo
(74) *Attorney, Agent, or Firm* — Nutter McClennen & Fish LLP; John J. Penny, Jr.

(57) ABSTRACT

An ink cartridge has a label portion on a wall surface of one periphery of a case forming an ink accommodating unit. The label unit has an optical functional layer that allows a predetermined wavelength of light to pass, an optical dispersion layer that includes hollow bodies, and an optical absorptive layer that absorbs the first wavelength of light, which are laminated in this order, and the optical absorptive layer is a surface side of the case. When the optical reflective layer is heated from a heating unit directed to the label portion at a temperature of damaging the hollow bodies, the dispersion of the light is suppressed by the damage to the hollow bodies, and the transmittance of the wavelength of light is irreversibly raised.

9 Claims, 8 Drawing Sheets

CARTRIDGE AND PRINTING APPARATUS

Priority is claimed under 35 U.S.C. §119 to Japanese Application No. 2011-213880 filed on Sep. 29, 2011 which are hereby incorporated by reference in its entirety.

BACKGROUND

1. Technical Field

The present invention relates to a cartridge that accommodates a printing material used for printing, and a printing apparatus in which the cartridge is provided.

2. Related Art

When a cartridge is provided for use in a printing apparatus, various kinds of information are transmitted and received between the cartridge and the printing apparatus. Accordingly, a technique of providing the cartridge with a storage element is proposed (for example, JP-A-2005-119228). In the storage element, information for a printing material accommodated in the cartridge such as a remaining printing material amount is stored according to the color of the printing material, and different kinds of printing materials are prevented from being supplied on the basis of the information.

The technique disclosed in JP-A-2005-119228 is a technique corresponding to a demand for recording any information about the cartridge. However, it is necessary to provide the cartridge with a storage element such as an EEPROM, and it is necessary to provide electrical connection for communication between a storage element of the cartridge and a control circuit unit of a recording apparatus body, and thus the structure of the cartridge is complex.

SUMMARY

An advantage of some aspects of the invention is to provide a new method of coping with the update of information about a cartridge.

The invention can be realized in the following forms or application examples.

APPLICATION EXAMPLE 1

Cartridge

According to Application Example 1, there is provided a cartridge which accommodates a printing material used for printing, wherein an optical functional layer that allows a predetermined wavelength of light to pass, an optical absorptive layer that is opposed to the optical functional layer and absorbs the wavelength of light, and an optical dispersion layer that is interposed between the optical absorptive layer and the optical functional layer and includes a plurality of hollow bodies dispersing the wavelength of light are laminated on a cartridge surface such that the optical absorptive layer is the side of the cartridge surface, and wherein the optical dispersion layer has a property and a state of irreversibly raising the transmittance of the wavelength of light by heat reception of at least a part of the plurality of hollow bodies from the outside.

A cartridge having the configuration can perform the update of information described hereinafter, by an optical functional layer, an optical absorptive layer, and an optical reflective layer laminated and provided on the cartridge surface. Hereinafter, for convenience of description the optical functional layer, the optical absorptive layer, and the optical reflective layer laminated and provided on the cartridge surface as described above are called a lamination unit, and the update of information in the cartridge having the configuration will be described.

When at least a part of the hollow bodies contained in the optical dispersion layer of the lamination unit is deformed by heat reception from the outside, the transmittance of the predetermined wavelength of light (hereinafter, referred to as "the first wavelength of light") of the optical dispersion layer is irreversibly raised. For this reason, before and after deformation of the hollow portions in the lamination unit, the transmittance with respect to the first wavelength of light in the optical dispersion layer differs in the range in which the hollow portions are deformed. Specifically, when the lamination unit is irradiated with the first wavelength of light from the side of the optical functional layer, a situation of reflection of the first wavelength of light from the optical dispersion layer is different before and after deformation of the hollow portions, from the difference of the transmittance in the optical dispersion layer. Accordingly, before and after the deformation of the hollow portion, the optical characteristics when the first wavelength of light is irradiated are changed. The change of the transmittance in the optical dispersion layer by the deformation of the hollow portions is irreversible.

The irreversible change of the optical characteristics of the lamination unit corresponds to an electrical data update in the storage element, for example, an update of information in which data is updated from a value of 0 to a value of 1 or vice versa. Therefore, according to the cartridge having the configuration, in the lamination unit provided on the cartridge surface, it is possible to perform an update of information about the cartridge. The irreversible change of the transmittance in the optical dispersion layer described above corresponds to an irreversible increase of the reflectance of the optical dispersion layer with respect to the first wavelength of light. It corresponds to the update of information in the lamination unit of the cartridge surface, and although it is not necessary to use the storage element, it is possible to use the storage element in concurrently.

The cartridge described above may be formed in the following aspect. For example, when the wavelength is in the infrared area, the optical functional layer may be a black layer. In this case, "black" means that the reflectance is equal to or less than 10% with respect to all the optical components in which the wavelength is in the range of 400 nm to 700 nm, when the intensity of regular reflection light is measured. For example, when the entire face of the optical dispersion layer is coated with the optical functional layer of the black layer, it is possible to cover the optical dispersion layer thereunder by the optical functional layer of the black layer, and thus it is difficult to recognize the irreversible change of the lamination unit by heat reception.

The wavelength is in the near-infrared area, the transmittance of the optical functional layer with respect to the wavelength can be equal to or more than 30%, and in the optical functional layer, the transmittance difference of any wavelength of the wavelength band of 700 to 800 nm of the near-infrared area and the wavelength band of 800 to 1500 nm can be equal to or more than 10%. That is, in the optical functional layer, the transmission spectrum in the near-infrared area represents high transmittance with respect to the first wavelength, and may represent low transmittance in other wavelengths. Accordingly, for a person who does not know that the first wavelength of light is being used, it is impossible or difficult to discriminate the irreversible change between the lamination unit before the light reception of the optical dispersion layer and the lamination unit after the light reception. For this reason, according to the aspect, it is difficult for a person who does not know using the first wavelength of light in the irreversible change of the lamination unit to recognize the irreversible change of the lamination unit.

The optical functional layer may be a coloring pattern opposed to a part of the optical absorptive layer with the optical dispersion layer interposed therebetween, and the optical absorptive layer may be a coloring layer with the same color as that of the optical functional layer. As described above, the lamination unit is deformed by the heat reception from the outside, and the optical absorptive layer is visible at least at a part thereof. When the pattern formed by the optical functional layer and the optical absorptive layer have the same color, it is difficult to or extremely difficult to observe the pattern formed by the optical functional layer with the naked eye, by the deformation. For example, when the optical functional layer is provided in a one-dimensional shape or two-dimensional shape, it is possible to make the code invisible by the deformation. As a result, it is possible to clearly recognize a state where the change of the lamination unit has been irreversibly performed through the deformation with the naked eye. Accordingly, the irreversible change of the lamination unit by the deformation is caused on the used-up cartridge of a printing material, and it is possible for the user to easily know that the cartridge is the used-up cartridge of the printing material by recognizing the cartridge having the irreversibly changed lamination unit.

An optical absorptive pattern layer in which a pattern with a shape that occupies a part of the optical functional layer is formed by a material absorbing the first wavelength of light may be further provided to form the optical absorptive pattern layer on either the front surface or the rear surface of the optical functional layer. In this case, when the lamination unit is irradiated with the first wavelength of light and it is observed, an image corresponding to the pattern of the optical absorptive pattern layer is observed. Meanwhile, when the optical dispersion layer of the lamination unit is in the state where the irreversible change is performed by the deformation, it is difficult to observe the image corresponding to the pattern of the optical absorptive pattern layer caused by the absorption of the first wavelength of light in the optical absorptive layer. As a result, it is possible to clearly recognize the state of the lamination unit where the irreversible change is completed through the deformation by the observation of the pattern image subjected to the irradiation of the first wavelength of light, and thus it is possible to obtain the same effect as that of the aspect described above.

In this case, when the pattern of the optical absorptive pattern layer and the optical functional layer have the same color, it is difficult to recognize the presence of the optical absorptive pattern layer when the lamination unit is observed with the naked eye.

A lamination unit in which the optical functional layer, the optical absorptive layer, and the optical dispersion layer are laminated as described above may be directly formed on the case surface or may be adhered onto the case surface.

APPLICATION EXAMPLE 2

Ink Cartridge

According to Application Example 2, there is provided a cartridge which accommodates a printing material used for printing, wherein an optical functional layer that allows a predetermined wavelength of light to pass, an optical absorptive layer that is opposed to the optical functional layer and absorbs the wavelength of light, and an optical dispersion layer that is interposed between the optical absorptive layer and the optical functional layer and includes a plurality of hollow bodies dispersing the wavelength of light are provided on a cartridge surface, wherein the optical dispersion layer has a property and a state of irreversibly raising transmittance of the wavelength of light by heat reception of at least a part of the plurality of hollow bodies from the outside, and wherein the optical functional layer is positioned on the incident side of the wavelength of light.

According to the cartridge with the configuration, it is possible to obtain the effect described above.

APPLICATION EXAMPLE 3

Cartridge Label

According to Application Example 3, there is provided a cartridge label attached to a cartridge accommodating a printing material used for printing, wherein an optical functional layer that allows a predetermined wavelength of light to pass, an optical absorptive layer that is opposed to the optical functional layer and absorbs the wavelength of light, and an optical dispersion layer that is interposed between the optical absorptive layer and the optical functional layer and includes a plurality of hollow bodies dispersing the wavelength of light are laminated, wherein the optical dispersion layer has a property and a state of irreversibly raising transmittance of the wavelength of light by heat reception of at least a part of the plurality of hollow bodies from the outside, and wherein a pattern representing information about the cartridge is formed by the optical functional layer.

With such a configuration, it is possible to read the information about the cartridge by observation of a pattern image representing the information about the cartridge formed by the optical functional layer.

APPLICATION EXAMPLE 4

Cartridge Label

According to Application Example 4, there is provided a cartridge label attached to a cartridge accommodating a printing material used for printing, wherein an optical functional layer that allows a predetermined wavelength of light to pass, an optical absorptive layer that is opposed to the optical functional layer and absorbs the wavelength of light, and an optical dispersion layer that is interposed between the optical absorptive layer and the optical functional layer and includes a plurality of hollow bodies dispersing the wavelength of light are laminated, wherein the optical dispersion layer has a property and a state of irreversibly raising transmittance of the wavelength of light by heat reception of at least a part of the plurality of hollow bodies from the outside, wherein an optical absorptive pattern layer provide with a pattern with a shape occupying a part of the optical functional layer by a material absorbing the wavelength of light is provided on either front or rear face of the optical functional layer, and wherein a pattern representing information about the cartridge is formed by the optical absorptive pattern layer.

Also according to the configuration, it is possible to read the information about the cartridge similarly to Application Example 3.

APPLICATION EXAMPLE 5

Printing Apparatus

According to Application Example 5, there is provided a printing apparatus which is provided with the cartridge any one of Application Examples, wherein the optical dispersion layer is provided with an irreversible treatment unit that performs an irreversible treatment of deforming at least a part of the hollow bodies such that the transmittance of the wavelength of light of the optical dispersion layer is irreversibly raised.

In the printing apparatus with the configuration, when any cartridge of Application Examples is mounted, the irreversible treatment is performed on the lamination unit of the mounted cartridge. The irreversible treatment is to apply the heat reception from the outside to the hollow portions of the light dispersion layer such that the transmittance of the wavelength of light of the optical dispersion layer in the lamination unit is raised. Therefore, according to the printing apparatus provided with the configuration, it is possible to cause the irreversible change in the lamination unit through the irreversible treatment. In this case, at least a part of the hollow bodies of the optical dispersion layer is subjected to the deformation.

The printing apparatus described above may be as follows. For example, the optical functional layer is irradiated with the wavelength of light, the reflection state thereof is read, and the reflection state read by the reading unit is contrasted before and after the irreversible treatment. In such a manner, it is possible to perform treatment corresponding to the irreversible change of the lamination unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
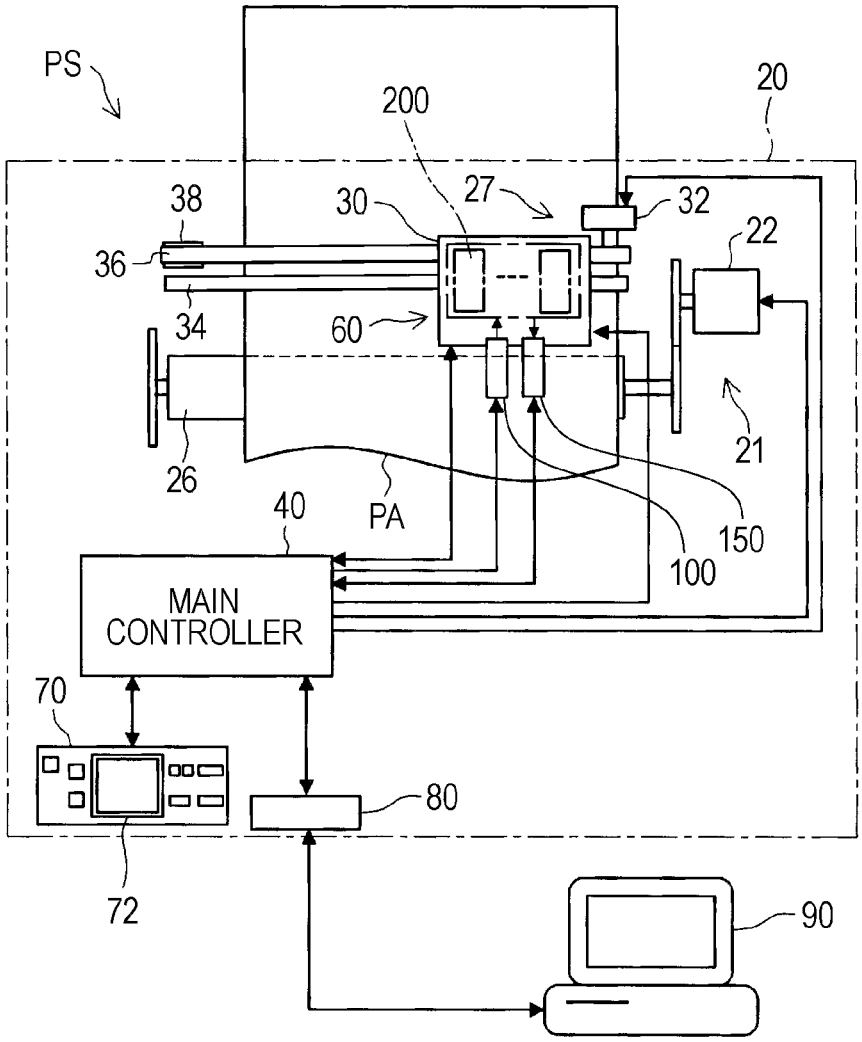
FIG. 1 is a diagram illustrating a schematic configuration of a printing system.

Hereinafter, an example of a printing system according to an embodiment will be described. FIG. 1 is a diagram illustrating a schematic configuration of a printing system PS. As shown in FIG. 1, the printing system PS includes a printer 20 as a printing apparatus, and a computer 90. The printer 20 is connected to the computer 90 through a connector 80.

The printer 20 includes a sub-scanning transport mechanism 21, a main scanning transport mechanism 27, a printing head unit 60, and a main control unit 40. The sub-scanning transport mechanism 21 includes a sheet transport motor 22, and a sheet transport roller 26, and transports a sheet PA in the sub-scanning direction using the sheet transport roller 26. The main scanning transport mechanism 27 includes a carriage motor 32, a pulley 38, a driving belt 36 provided between the carriage motor 32 and the pulley 38, and a sliding shaft 34 provided in parallel to the sheet transport roller 26. The sliding shaft 34 is slidably provided with the carriage 30 fixed to the driving belt 36. The rotation of the carriage motor 32 is transferred to the carriage 30 through the driving belt 36, and the carriage 30 is reciprocally moved in the main scanning direction parallel to the axial direction of the sheet transport roller 26 along the sliding shaft 34.

The printing head unit 60, in which the carriage 30 is provided with an ink cartridge 200 and a printing head (not shown), drives the printing head while the printing head unit 60 is driven in the main scanning direction by the carriage 30, and eject the ink accommodated in the ink cartridge 200 onto the sheet PA. The main control unit 40 controls the mechanisms to realize a printing process. The main control unit 40 receives a printing job of a user, for example, through a computer 90, and control the mechanisms described above to perform the printing on the basis of the content of the received printing job. Each ink cartridge 200 is detachably mounted on the carriage 30. The printing head has a plurality of nozzle rows for ejecting different inks. The printing head unit 60 includes a heating unit 100 and a reading unit 150. The heating unit 100 performs heat radiation on the label unit 210 provided on the ink cartridge 200 to be described later. The reading unit 150 performs light irradiation to the label unit 210, and reading of the reflection light thereof. The heating or reading performed on the label unit 210 will be described later.

The printer 20 is provided with an operation unit 70 for performing various settings of the printer 20 by a user, or for confirming a status of the printer 20. The operation unit 70 is provided with a display unit 72 for performing various reports to the user.

Figure 2:
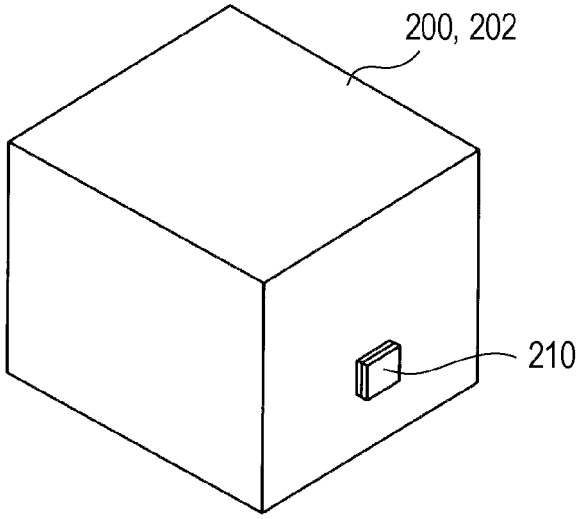
FIG. 2 is a diagram schematically illustrating an ink cartridge and a label portion.
Figure 3:
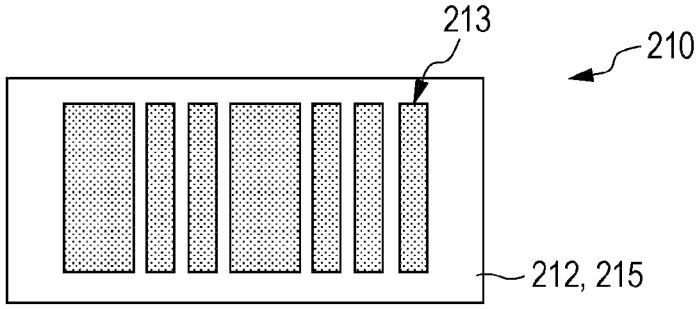
FIG. 3 is a front view illustrating the label unit.
Figure 4:
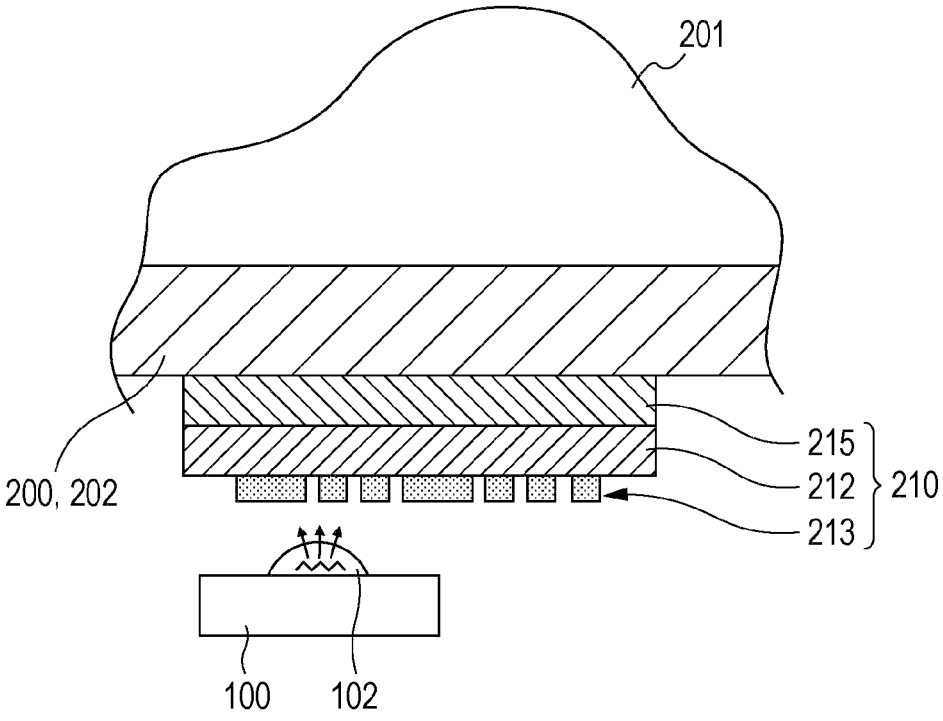
FIG. 4 is a cross-sectional view illustrating a relationship with a heating unit while viewing the label unit of the ink cartridge.

FIG. 2 is a diagram schematically illustrating the ink cartridge 200 and the label unit 210, FIG. 3 is a front view of the label unit 210, and FIG. 4 is a cross-sectional view illustrating a relationship with a heating unit 100 while viewing the label unit 210 of the ink cartridge 200.

As shown in FIG. 2, the label unit 210 is formed on one peripheral wall surface of a case 202 forming an ink accommodating unit 201 in the ink cartridge 200. The label unit 210 has a lamination structure in which a plurality of layers with different properties and states are laminated, as shown in FIG. 4, the optical functional layer 213, the optical dispersion layer 212, and the optical absorptive layer 215 are laminated in this order, the optical absorptive layer 215 is the surface side of the case 202. The optical functional layer 213 has a property and state of allowing a predetermined wavelength of light (hereinafter, the wavelength is referred to as a first wavelength, and the light is referred to as first wavelength of light) to pass, the optical dispersion layer 212 has a property and state of dispersing the first wavelength of light, and the optical absorptive layer 215 has a property and state of absorbing the first wavelength of light. The property and state will be described later.

The optical absorptive layer 215 has a property and state in which absorptivity with respect to the first wavelength of light is more than absorptivity of the optical dispersion layer 212 with respect to the first wavelength of light and absorptivity of the optical functional layer 213 with respect to the first wavelength of light after forming the label unit 210, and absorbs the first wavelength of light by the property and state. The absorptivity of the optical absorptive layer 215 with respect to the first wavelength light is, for example, equal to or more than 70%, and generally, equal to or more than 90%.

When the first wavelength of light is in the near-infrared area, the optical absorptive layer 215 contains, for example, a near-infrared absorbing agent and resin. The near-infrared absorbing agent may be, for example, carbon black used in the process ink. The resin may be, for example, resin generally used in a process ink. Herein, the "near-infrared area" means a wavelength band of 700 nm to 1500 nm.

The optical absorptive layer 215 may be formed, for example, by a printing method. The printing method may be, for example, an offset printing method, a gravure printing method, a screen printing method, and a flexo printing method. A thickness of the optical absorptive layer 215 is, for example, in the range of 0.5 to 10 μm, and generally, in the range of 0.5 to 2 μm. To form the optical absorptive layer 215 on the surface of the case 202, the ink cartridge 200 is set in the printing apparatus of the printing method described above, and an ink A having the following composition is applied into an area of 30 mm×30 mm at a predetermined part of the surface of the case 202 using a bar coater, and a dried film thickness at that time is 1 μm. By drying the coating film, it is possible to print and form the optical absorptive layer 215 on the surface of the case 202.

Composition of Ink A

FD Carton ACE Smilo (manufactured by Toyo Ink Co., Ltd.)

Black Ink (Fine Star R92 Black: manufactured by Toyo Ink Co., Ltd.)

The optical dispersion layer 212 includes hollow bodies that disperse the first wavelength of light. The optical dispersion layer 212 disperses the first wavelength of light at least over the period from the completion of the label unit 210 to the time of performing the irreversible treatment to be described later. The optical dispersion layer 212 is subjected to the irreversible treatment of damaging the hollow bodies, and has a property and state of irreversibly raising the transmittance in the first wavelength, in the range (the heat reception range to be described later) of the treatment.

In the optical dispersion layer 212, the transmittance T1 with respect to the first wavelength of light is, for example, in the range of 0 to 50%, and generally, in the range of 20 to 40%, before being subjected to the irreversible treatment to be described later. After the irreversible treatment to be described later, the transmittance T2 of the optical dispersion layer 212 with respect to the first wavelength of light is, for example, in the range of 60 to 100%, and generally, in the range of 70 to 90%. A ratio of the transmittance T2 and the transmittance T1 is, for example, equal to or more than 1.2, and generally, in the range of 1.75 to 4.5.

The hollow bodies contained in the optical dispersion layer 212 may be, for example, organic polymer having a hollow structure. A composition and a producing method of such organic polymer is disclosed, for example, JP-A-56-32513, JP-A-61-185505, JP-A-60-69103, JP-A-63-213509, JP-A-63-135409, JP-A-60-223873, JP-A-63-110208, JP-A-61-87734, or JP-A-62-127336.

Each of the hollow bodies contained in the optical dispersion layer 212 is generally provided with a core component, and a shell component surrounding it. The core component is formed using, for example, methacrylic acid, or methacrylic acid and other monomer. The shell component is formed using, for example, styrene. A particle diameter of the hollow body is, for example, 0.1 to 5 μm, and generally, 0.3 to 1 μm.

The polymer retaining the hollow bodies is generally is aqueous polymer having film formability. Generally, the polymer is synthesized by emulsion polymerization, solution polymerization, and bulk polymerization. The polymer retaining the hollow bodies has reversibility to the extent that the collapsing of the hollow bodies is not disturbed in the irreversible treatment to be described later. A glass transition point of the aqueous polymer is, for example, equal to or lower than 100° C., and generally, in the range of −80° C. to 25° C.

The aqueous polymer may be, for example, water dispersible polymer, and water soluble polymer. The water dispersible polymer is polymer which can be dispersed in water. The water soluble polymer is polymer which can be dissolved in water.

Monomer constituting the water dispersible polymer may be, for example, acrylic acid ethyl ester (EA), acrylic acid butyl ester (BA), acrylic acid 2-ethylhexyl ester (2EHA), and butadiene. Each of the monomers may constitute homopolymer, and may constitute copolymer with one or more kinds of monomers. Particularly preferable polymer is polymer obtained by reaction of hexamethylene diisocyanate and polycarbonate polyol.

The monomer constituting the water soluble polymer may be, for example, carboxylic acid derivative of monomer listed for water dispersible polymer. The derivative may be, for example, acrylic acid (Aa), methacrylic acid, monomethyl itaconic acid (MMI), and 2-carboxyethyl acrylic ester. At least a part of the carboxy group in the monomer is in a form of alkali metal salt, amine salt, and ammonium salt, and the polymer configured from the derivatives is dissoluble in water.

A mass ratio of the hollow bodies in the optical dispersion layer 212 and the polymer retaining the hollow bodies is, for example, in the range of 1:1 to 1:100. The optical dispersion layer 212 may further include plasticizer, wetting agent, antifoaming agent, thickening agent, emulsifier, and wax such as carnauba wax and paraffin wax.

The optical dispersion layer 212 has an optical dispersion property, and generally represents white. The optical dispersion layer 212 covers at least a part of the optical absorptive layer 15 at least over the period from the completion of the label unit 210 to the time when the irreversible treatment is performed.

The optical dispersion layer 212 is formed by, for example, a coating method. The coating may be performed using, for example, an air knife coater, a roll coater, a spray coater, a gravure coater, a micro gravure coater, or a miyaba coater. A film thickness of the optical dispersion layer 212 is, for example, in the range of 5 to 20 μm, and generally, in the range of 5 to 15 μm.

The optical dispersion layer 212 may be produced using the ink B.

Composition of Ink B

Ropaque OP-84J (manufactured by Dow Chemical Company) 25 parts by mass

Acryl Emulsion Polymer 12.5 parts by mass

Water 30 parts by mass

In the embodiment, as shown in FIG. 3 and FIG. 4, the optical functional layer 213 is formed in the pattern shape, and the formed pattern of the optical functional layer 213 is configured as the 1-dimensional code. The pattern of the optical functional layer 213 may be configured as the 2-dimensional code, and may have another pattern configuration such as a character, a symbol, and a shape, and a figure. In this case, the formed pattern of the optical functional layer 213 may be different according to unique information in the ink cartridge 200, for example, an ink color, and the pattern of the optical functional layer 213 may represent such information.

The optical functional layer 213 may be colored. For example, the optical functional layer 213 may be a colored pattern. When the optical functional layer 213 is the colored pattern, it is preferable that the optical functional layer 213 and the optical functional layer 215 have the same color. When the pattern formed in the optical functional layer 213 and the optical absorptive layer 215 have the same color, the pattern formed in the optical functional layer 213 cannot be observed, or the observation is drastically difficult, after the irreversible treatment described about the optical dispersion layer 212. As a result, it is possible to clearly recognize the performing of the irreversible treatment on the label unit 210 with the naked eye. Therefore, it is possible to psychologically suppress action such as reformation of the label unit 210.

Generally, the optical functional layer 213 is a black layer. For example, when the optical functional layer 213 coats the entire face of the optical dispersion layer 212, and when the optical functional layer 213 is the black layer, it is impossible or difficult to recognize whether or not the irreversible treatment is performed on the label unit 210 with the naked eye. Therefore, it is difficult to recognize that the label unit 210 in the ink cartridge 200 has a special configuration. In this case, the "black" means that the reflectance is equal to or less than 10% with respect to all the optical components in which the wavelength is in the range of 400 nm to 700 nm, when intensity of regular reflection light is measured.

When the first wavelength is in the near-infrared area, the optical functional layer 213 in which the transmittance in the first wavelength is equal to or more than 30%, and the optical functional layer 213 in which a transmittance difference of any wavelength of the wavelength band of 700 to 800 nm of the near-infrared area and the wavelength band of 800 to 1500 nm of the near-infrared area is equal to or more than 10% may be used. That is, in the optical functional layer 213, transmittance spectrum in the near-infrared area represents high transmittance with respect to the first wavelength, and may represent low transmittance in the other wavelengths. Herein, as an example, the optical functional layer 213 has such optical characteristics. Herein, when the wavelength of light (hereinafter, referred to as the second wavelength of light) different from the first wavelength is in the near-infrared area, or in the near-infrared area, the transmittance of the optical functional layer 213 with respect to the second wavelength is equal to or less than transmittance of the optical functional layer 213 with respect to the first wavelength, for example, may be equal to or less than 10% of the transmittance of the optical functional layer 213 in the first wavelength.

The optical functional layer 213 having the optical characteristics, that is, the optical characteristics of allowing the light in a part of the wavelength band to selectively pass and absorbing the other light includes, for example, a predetermined near-infrared absorbing agent and resin. The near-infrared absorbing agent absorbs the second wavelength of light. The near-infrared absorbing agent may be, for example, at least one selected from the group consisting of a phthalocyanine compound, a phthalocyanine compounds, an anthraquinone compound, a diimonium compound, an a cyanine compound. The resin may be, for example, resin generally used in the process ink.

The near-infrared absorbing agent used as the optical functional layer 213, generally, the near-infrared absorbing agent used in the optical absorptive layer 215 has a difference in absorptive spectrum of the near-infrared area. For example, the absorptivity of the near-infrared absorbing agent used as the optical functional layer 213 with respect to the first wavelength of light is less than the near-infrared absorbing agent used in the optical absorptive layer 215. Alternatively, the near-infrared absorbing agent used as the optical functional layer 213 may be the compound exemplified as the near-infrared absorbing agent which can be contained in the optical absorptive layer 215.

Similarly to the optical dispersion layer 212, the optical functional layer 213 is formed by a printing method such as the offset printing method, the gravure printing method, the screen printing method, and the flexo printing method. A thickness of the optical reflective layer 213 is, for example, in the range of 0.5 to 10 μm, and generally, in the range of 1 to 5 μm. To form the optical functional layer 213, for example, the ink cartridge 200 in which the optical absorptive layer 215 and the optical dispersion layer 212 are formed is set in the offset printing apparatus, printing is performed with a pattern shown in FIG. 3 using an ink C with the following composition to overlap with the optical dispersion layer 212, and a dried film thickness at that time is 1 μm. Thereafter, the coating film is irradiated with ultraviolet light such that the optical functional layer 213 is formed to overlap with the optical dispersion layer 212. As described above, the label unit 210 in which the optical absorptive layer 215 and the optical dispersion layer 213 are laminated on the optical functional layer 212 was observed from the side of the surface of the case 202 with the naked eye, and a pattern shown in FIG. 3 was viewed as black.

Composition of Ink C

Near-Infrared Absorptive Pigment YKR-3081 (manufactured by Yamamoto Chemicals, Inc.) 5 parts by mass FD Carton ACE Medium (manufactured by Toyo Ink Co., Ltd.) 95 parts by mass As shown in FIG. 4, the heating unit 100 is opposed to the label unit 210 on the cartridge surface in the ink cartridge 200. In this case, the heating unit 100 may be constantly opposed to the label unit 210 of the ink cartridge 200, and the heating unit 100 is set in a 2-dimensional table or a 3-dimensional table and may be retractable with respect to the label unit 210. The heating unit 100 is provided with a thermal head 102 to face the label unit 210, and heats the label unit 210 from the side of the optical functional layer 213 in the thermal head 102 by a control of the main control unit 40 (FIG. 1). In the heating, the optical dispersion layer 212 in which the hollow portions are formed as described above is at least heated, and the optical dispersion layer 212 causes damage to the hollow bodies to irreversibly raise the transmittance of the first wavelength of light in the heat reception range of the heat received from the thermal head 102. The treatment of heating the label unit 210 by the heating unit 100 to irreversibly raise the transmittance of the optical dispersion layer 212 with respect to the first wavelength of light is the irreversible treatment. In the embodiment, the heating temperature is a temperature of 120° C. (an irreversible change temperature) capable of damaging at least a part of the hollow bodies in the optical dispersion layer 212. At the irreversible change temperature, gas in the hollow bodies is expanded to destroy a shell thereof. When the optical dispersion layer 212 is subjected to heat reception by the thermal head 102 as described above, the thermal head 102 may come in contact with the surface of the label unit 210.

Figure 5A:
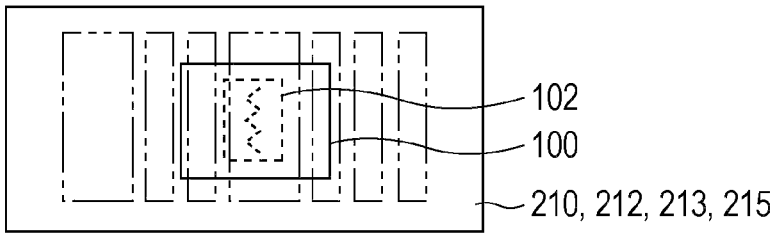
FIG. 5A and FIG. 5B are diagrams illustrating a positional relationship between the label portion and the heating unit while viewing the label portion in the front view from the side of an optical functional layer.
Figure 5B:
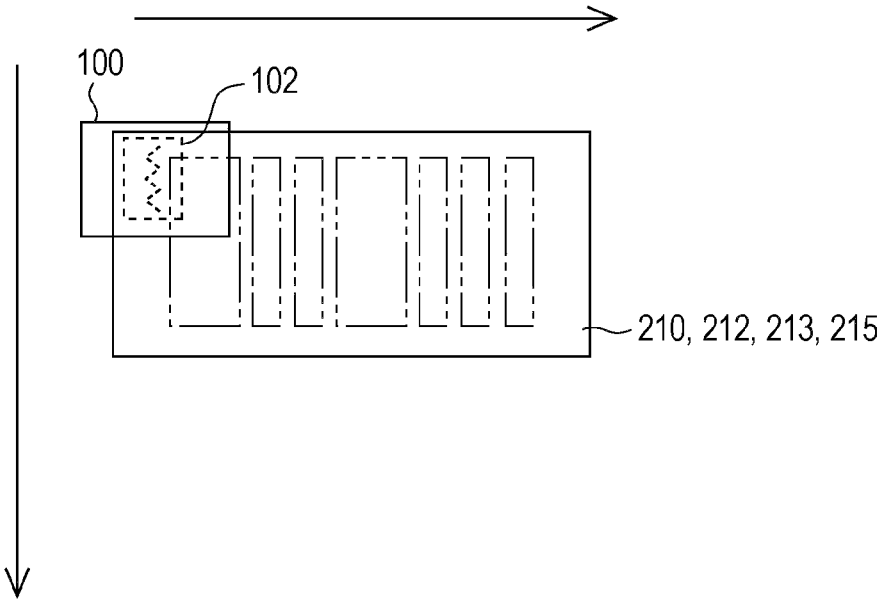
Figure 6:
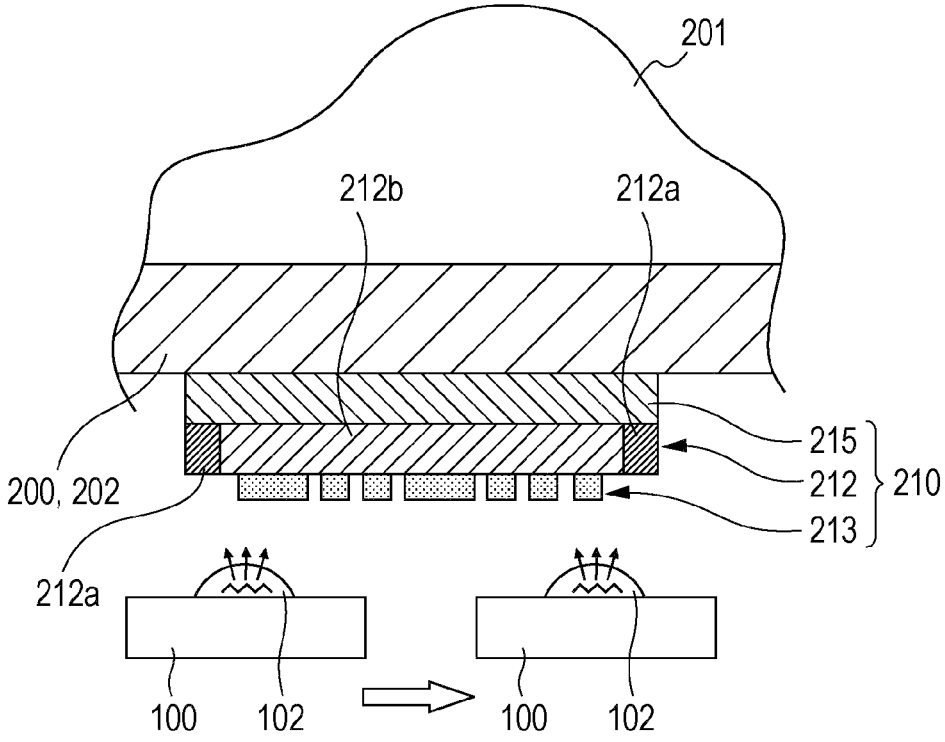
FIG. 6 is a diagram schematically illustrating change of an optical reflective layer when the heating unit is scanned in one direction with respect to the label portion.

FIG. 5A and FIG. 5B are front views illustrating a positional relationship between the label unit 210 and the heating unit 100 while viewing the label unit 210 from the side of the optical functional layer 213, and FIG. 6 is a diagram schematically illustrating change of the optical dispersion layer 212 when the heating unit 100 is scanned in one direction with respect to the label unit 210. As shown in FIG. 5A and FIG. 5B, in the heating unit 100, the thermal head 102 thereof may be opposed to only one part of the label unit 210 (FIG. 5A), and may be scanned vertically and horizontally with respect to the label unit 210 or in one direction thereof by the 2-dimensional or 3-dimensional table described above (FIG. 5B). In the case shown in FIG. 5A, by the irreversible treatment based on the heating unit 100, in the label unit 210, specifically, in the optical dispersion layer 212, irreversible increase of the transmittance occurs in the heat reception range at one part of the heating unit 100 opposed to the thermal head 102. Meanwhile, in the case shown in FIG. 5B, a trace similar to a scanning trace of the heating unit 100 is the heat reception range. Accordingly, in the optical dispersion layer 212, the irreversible increase of the transmittance occurs in a continuous heat reception range similar to the scanning trance of the thermal head 102.

Figure 7:
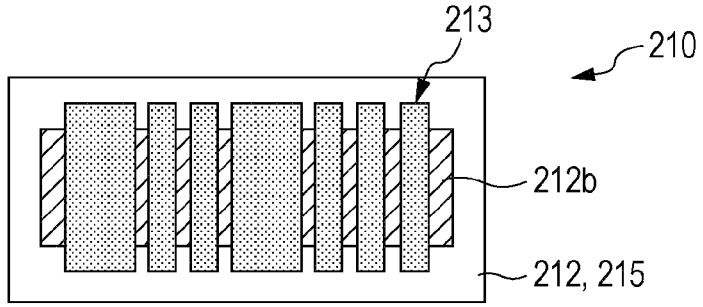
FIG. 7 is a front view schematically illustrating change of an optical reflective layer when the heating unit is scanned in one direction with respect to the label portion.

FIG. 6 shows the change of the optical dispersion layer 212 when the heating unit 100 is scanned in one direction. FIG. 7 is a front view schematically illustrating the change of the optical dispersion layer 212 when the heating unit 100 is scanned in one direction with respect to the label unit 210. As shown in FIG. 7, the optical dispersion layer 212 is subjected to the irreversible treatment in the heat reception portion 212*b* corresponding to the heat reception range similar to the scanning trace of the heating unit 100, and irreversibly raises the transmittance with respect to the first wavelength of light in the heat reception range 212*b*. Meanwhile, at the non-heat reception portion 212*a* which is not subjected to heat reception, the transmittance is as before the irreversible treatment. At the part of the label unit 210 corresponding to the heat reception portion 212*b*, the first wavelength of light passes through both of the optical functional layer 213 and the optical dispersion layer 212. The first wavelength of light is absorbed by the optical absorptive layer 215. Accordingly, the part of the label unit 210 corresponding to the heat reception portion 212*b* represents spectrum characteristics caused by the absorption in the optical absorptive layer 215, by the irradiation of the first wavelength of light. As a result, at this part, it is impossible to detect or drastically difficult to detect the unique spectrum characteristics in the optical functional layer 213. That is, the spectrums characteristics of the part are different from each other before and after the irreversible treatment.

Figure 8:
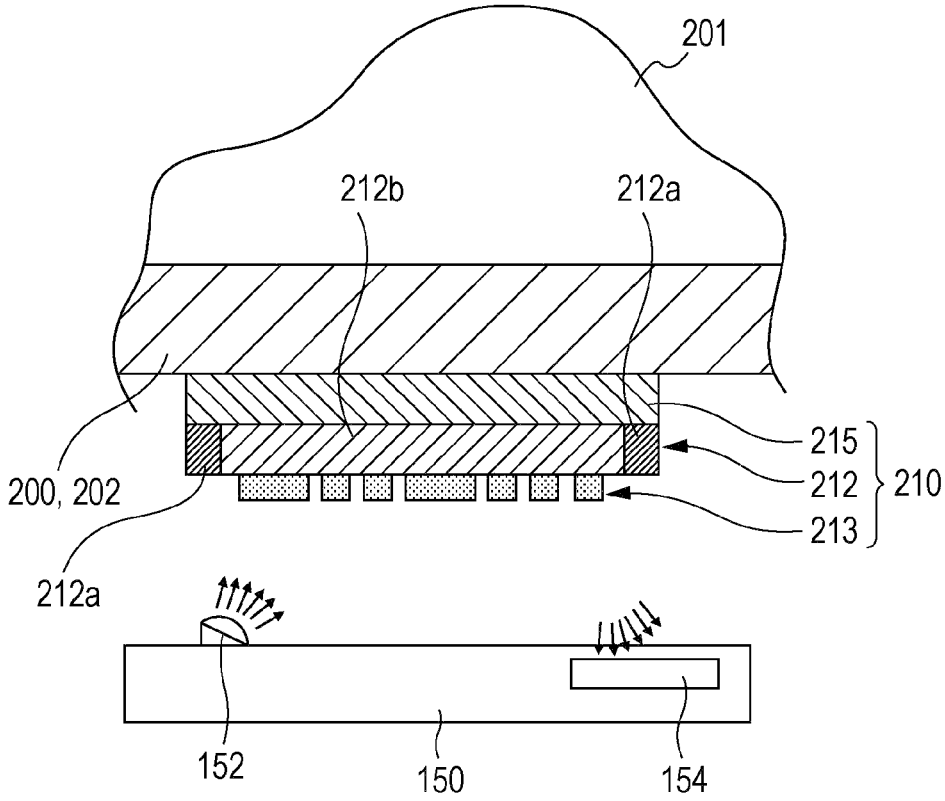
FIG. 8 is a diagram illustrating a relationship between a function of a reading unit and the label unit.

FIG. 8 is a diagram illustrating a relationship between a function of the reading unit 150 and the label unit 210. As shown in FIG. 8, the reading unit 150 is opposed to the label unit 210 on the cartridge surface in the cartridge 200. In this case, similarly to the heating unit 100, the reading unit 150 may be also constantly opposed to the label unit 210, the reading unit 150 is set in a 2-dimensional table or a 3-dimensional table and is retractable with respect to the label unit 210. The reading unit 150 is provided such that the irradiation unit 152 and the light receiving unit 154 are opposed to the label unit 210, and is controlled by the main control unit 40 (FIG. 1) to perform light irradiation by the irradiation unit 152 and reading by the light receiving unit 154. The irradiation unit 152 is provided therein with an infrared LED (light-emitting diode), and irradiates light (the first wavelength of light) with a wavelength of 800 nm as the first wavelength. The light receiving unit 154 is formed of a CCD (charge-coupled device) camera, and the light irradiated from the irradiation unit 152 is dispersed by the optical dispersion layer 212, the light receiving unit 154 receives the dispersion light. In this case, the light receiving unit 154 is configured to receive the light of the infrared area including the first wavelength by an optical filter (not shown). In this case, when the label unit 210 is irradiated with the first wavelength of light, the label unit 210 represents unique spectrum characteristics in the optical functional layer 213 on the basis of the dispersion light from the optical dispersion layer 212. The spectrum characteristics are specific matter corresponding to a specific configuration of the label unit 210. The spectrum characteristics are measured to determine whether or not the label unit 210 are honest.

In the optical functional layer 213, a transmittance difference of any wavelength of the wavelength band of 700 to 800 nm of the near-infrared area and the wavelength band of 800 to 1500 nm of the near-infrared area is equal to or more than 10%. Accordingly, it is light in the visible light area or the wavelength band, light representing transmittance lower than the transmittance of the first wavelength of light with respect to the optical functional layer 13 is irradiated from the irradiation unit 152, the reflection light thereof is received by the light receiving unit 154, the pattern formed in the optical functional layer 13 is recognized, and thus the information about the ink cartridge may be read.

Figure 9:
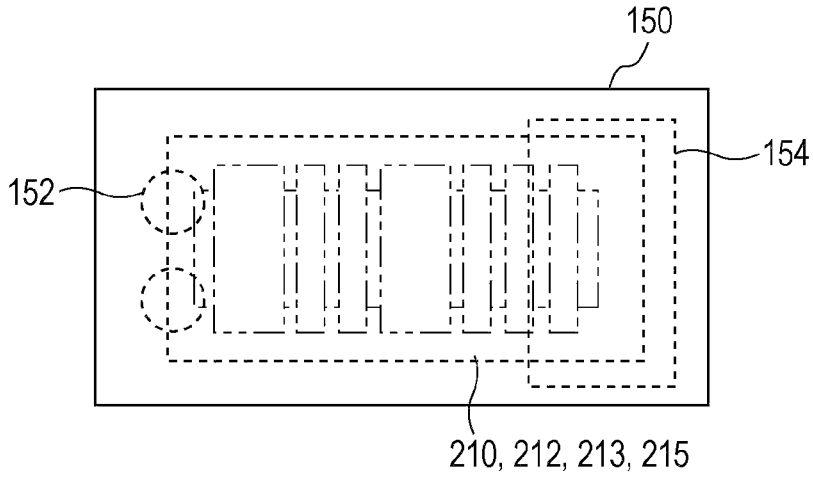
FIG. 9 is a front view illustrating a positional relationship between a label unit and a reading unit while viewing the label unit from the side of the optical functional layer.

FIG. 9 is a front view illustrating a positional relationship between the label unit 210 and the reading unit 150 while viewing the label unit 210 from the side of the optical function layer 213. As shown in FIG. 9, the reading unit 150 irradiates the wavelength (the first wavelength) light from the plurality of irradiation units 152 to the front face of the label unit 210, and the light receiving unit 154 receives the reflection light from the front face of the label unit 210. Accordingly, even in the irreversible treatment by the heating unit 100 in a case of the difference described in FIG. 5A and FIG. 5B, the reading unit 150 can read the reflection state represented by the optical dispersion layer 212 in which the irreversible increase of the transmittance is caused by the irreversible treatment.

The printer 20 performs the irreversible treatment using the thermal head 102 by the heating unit 100, at the timing (the irreversible change timing) when the ink accommodated in the ink cartridge 200 is used up. Specifically, the main control unit 40 acquires the ink remaining amount of the ink cartridge 200 from accumulation of the processed printing job, and transmits a control signal to the heating unit 100 when the remaining amount becomes an ink amount in which the next printing job cannot be performed. The heating unit 100 receives the control signal, and raises the temperature of the thermal head 102 to the irreversible temperature of 160° C. described above, and radiates the heat to the label unit 210. The time of the heat radiation is sufficient in that the optical dispersion layer 212 receives the heat to cause the irreversible increase of the transmittance. When the heating unit 100 is scanned as shown in FIG. 5B, the heat radiation time is secured while adjusting the scanning speed.

When the ink cartridge 200 is mounted on the carriage 30, the printer 20 transmits a control signal from the main control unit 40 to the reading unit 150 at the timing (the reading timing). The reading unit 150 performs the light irradiation by the irradiation unit 152 and the reading of the reflection light by the light receiving unit 154, and transmits the reading result to the main control unit 40. The main control unit 40 stores the reading situation before the irreversible treatment by the heating unit 100 in advance, and compares the reading result of the light receiving unit 154 with the stored reading situation, and it is possible to specify whether the ink cartridge 200 newly mounted on the carriage 30 is subjected to the irreversible treatment or is subjected to the treatment. Alternatively, before and after the irreversible treatment as described above, the unique spectrum characteristics in the optical functional layer 213 are different. Accordingly, it is possible to specify whether the ink cartridge 200 on which the carriage 30 is newly mounted is not subject to the irreversible treatment or is subjected to the treatment, on the basis of the difference of the spectrum characteristics.

More specifically, before the ink cartridge is subjected to the irreversible treatment by the heating unit 100, the optical dispersion layer 212 is the non-heat reception portion 212*a* in the entire area thereof. Accordingly, in the state where the label unit 210 is formed on the ink cartridge 200 accommodating the predetermined full amount of ink, when the label unit 210A is observed from the front face with the naked eye, the pattern shown in FIG. 3 is viewed as black.

When the ink of the ink cartridge 200 provided with the label unit 210 is used up in the printer 20, and when the heating unit 100 is scanned with respect to the label unit 210A as shown in FIG. 6, in the label unit 210, as shown in FIG. 7, a new pattern image is generated in the range of the heat reception portion 212*b* corresponding to the heat reception range similar to the scanning trace of the heating unit 100, and the pattern image is overlapped with the pattern of the optical functional layer 213. The heat receiving unit 154 transmits the reading result in which the new pattern image is overlapped, to the main control unit 40, and thus the main control unit 40 recognizes the pattern image in which the new pattern image is overlapped.

According to the printing system PS of the embodiment described above, there is the following advantage.

The ink cartridge 200 of the embodiment is provided with the label unit 210 on the surface of the case 202, the label unit 210 is the lamination unit in which the optical absorptive layer 215, the optical dispersion layer 212, and the optical functional layer 213 are laminated from the cartridge surface face side. In the state where the ink cartridge 200 is mounted on the carriage 30 as shown in FIG. 1, the label unit 210 is subjected to the irreversible treatment through the heating unit 100 provided in the printing head unit 60 of the printer 20 at the irreversible change timing. The optical dispersion layer 212 of the label unit 210 is subjected to the irreversible treatment and is heated by the terminal head 102 of the heating unit 100, to cause the irreversible increase of the absorptivity with respect to the first wavelength (800 nm) in the heat reception range (see FIG. 5A and FIG. 5B). For this reason, in the optical dispersion layer 212 of the label unit 210, the transmittance with respect to the first wavelength of light (the light with the wavelength of 800 nm) is different from the heat reception range before and after the irreversible treatment with the heat reception.

The printer 20 irradiates the label unit 210 of the ink cartridge 200 with the first wavelength of light (the light with the wavelength of 800 nm) from the side of the optical functional layer 213 from the irradiation unit 152 of the reading unit 150 at the reading timing where the ink cartridge 200 is mounted on the carriage 30, and reads the reflection state of the first wavelength of light from the optical functional layer 213 by the light receiving unit 154 (see FIG. 8 and FIG. 9). When the ink cartridge 200 newly mounted on the carriage 30 is a cartridge that fully accommodates a predetermined ink without being mounted in advance on the carriage 30, the cartridge was not subjected to the irreversible treatment by the heating unit 100. Accordingly, in the reading result with respect to the newly mounted ink cartridge 200 by the light receiving unit 154, the irreversible increase of the transmittance with respect to the first wavelength of light (the light with the wavelength of 800 nm) are not caused.

Meanwhile, when the ink cartridge 200 newly mounted on the carriage 30 is previously subjected to the irreversible treatment by the heating unit 100, in the reading result with respect to the newly mounted ink cartridge 200 by the light receiving unit 154, the irreversible increase of the transmittance with respect to the first wavelength of light (the light with the wavelength of 800 nm) is reflected. That is, the change of the irreversible absorptivity of the optical dispersion layer 212 of the label unit 210 subjected to the irreversible treatment corresponds to electrical data update in the storage element, for example, update of information of updating a data value from 0 to 1 or vice versa. Therefore, according to the ink cartridge 200 of the embodiment, the irreversible change of the label unit 210 corresponds to the electrical data update in the storage element, for example, the update of information of updating the data value from 0 to 1 or vice versa, thus corresponds to the update of information, and the storage element is not necessary. The storage element may be used commonly with the label unit 210.

According to the printer 20, the irreversible change of the transmittance of the optical dispersion layer 212 in the label unit 210 is caused at the timing when the ink of the ink cartridge 200 is used up. Accordingly, even when the ink cartridge 200 in which the ink is used up is erroneously mounted on the carriage 30, the erroneous mounting is displayed on the display unit 72 of the operation unit 70 for use to know it, and thus the storage element is not necessary in such recognition. When the pattern of the optical functional pattern layer 213 is different according to unique information in the ink cartridge 200, for example, an ink color, it is possible to specify the ink color from the reading result at the time of mounting the cartridge.

In the printer 20 of the embodiment, the irreversible treatment is performed at the timing when the ink of the ink cartridge 200 is used up, the transmittance of the optical dispersion layer 212 in the label unit 210 is irreversibly raised, and it is difficult to return the transmittance of the optical dispersion layer 212 to the state before the irreversible treatment. Accordingly, as for the ink cartridge 200 for which it is difficult to know whether or not an honest product, it is possible to determine whether to perform the irreversible treatment on the label unit 210. This means that it is possible to determine authenticity of the ink cartridge 200 for which it is difficult to know whether or not the honest product. Accordingly, it is possible to prevent the label unit 210 from being peeled off to try to reuse.

Figure 10:
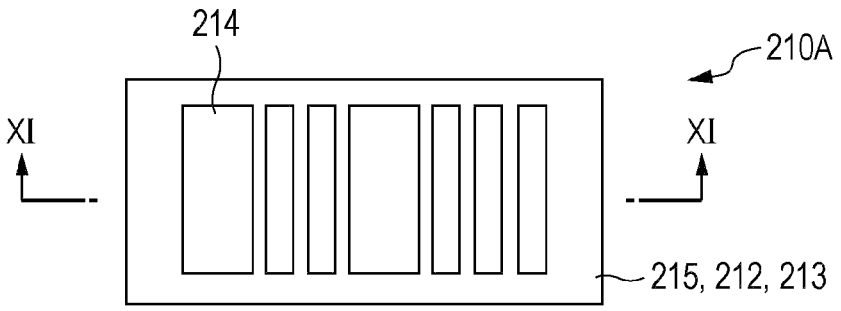
FIG. 10 is a front view illustrating a label unit of a first modification example.

Next, a second modification example will be described. FIG. 10 is a front view illustrating a label unit 210A of a modification example, and FIG. 11 is a cross-sectional view of XI-XI of FIG. 10.

Figure 11:
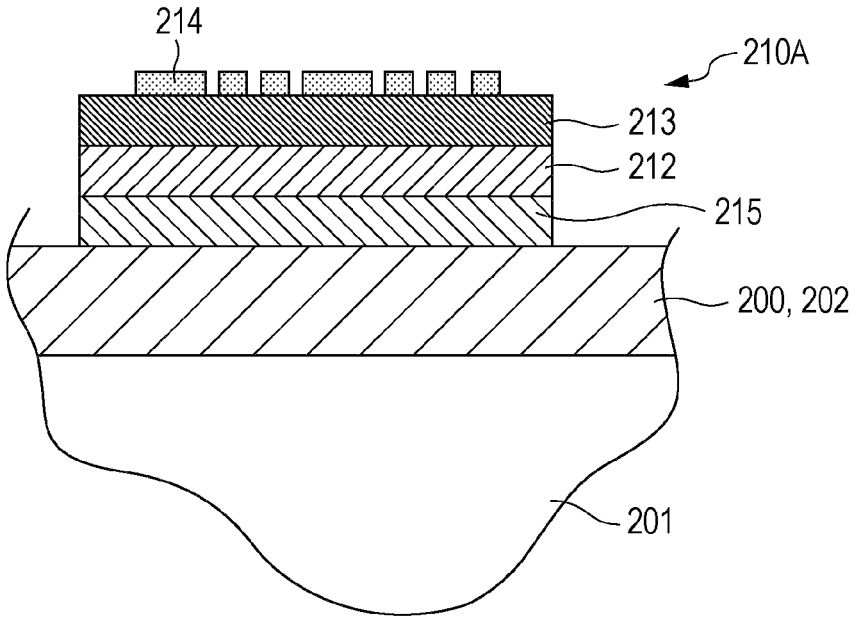
FIG. 11 is a cross-sectional view of XI-XI of FIG. 10.

As shown in FIG. 10 and FIG. 11, in the label unit 210A of the modification example, all of the optical absorptive layer 215, the optical dispersion layer 212, and the optical functional layer 213 are laminated to be a thin film on the surface of the case 202 of the ink cartridge 200, and then an optical absorptive pattern layer 214 is laminated on the optical functional layer 213. In this case, the optical functional layer 213 is laminated and formed to coat the entirety of the main face of the optical dispersion layer 212, differently from the embodiment described above. In the optical absorptive pattern layer 214, a 1-dimensional code pattern shown in FIG. 10 is formed of the same optical absorptive material as that of the optical absorptive layer 215 to be described later on the optical functional layer 213, and faces the optical dispersion layer 212 with the optical functional layer 213 interposed therebetween. In the example shown in FIG. 10 and FIG. 11, the pattern of the optical absorptive pattern layer 214 is the 1-dimensional code, but may be a 2-dimensional code pattern or the other pattern such as a character, a symbol, a shape, and a figure. When the pattern of the optical absorptive pattern layer 214 is different according to unique information in the ink cartridge 200, for example, an ink color, it is possible to specify the ink color from the reading result at the time of mounting the cartridge. Preferably, the optical absorptive pattern layer 214 is the same color as that of the optical functional layer 213, or is a light color as long as it represents sufficient absorptivity with respect to the first wavelength of light. In such a manner, when the label unit 210A is observed with the naked eye, it is difficult to know the presence of the optical absorptive pattern layer 214.

The pattern of the optical absorptive pattern layer 214 is preferably distributed over the entire area of the area corresponding to the optical dispersion layer 212. In this case, it is difficult to analyze the spectrum characteristics of the optical functional layer 213. The optical absorptive pattern layer 214 is formed by, for example, a printing method. The printing method may be, for example, an offset printing method, a gravure printing method, a screen printing method, and a flexo printing method. Alternatively, the optical absorptive pattern layer 214 may be formed using a thermal transfer ribbon. That is, the ink cartridge 200 on which the optical absorptive layer 215, the optical dispersion layer 212, and the optical functional layer 213 are formed in the film state is processed by the printing method, and the optical absorptive pattern layer 214 is formed on the surface of the optical functional layer 213. That is, it is formed on the optical functional layer 213 using a gravure calibration machine using an ink D in the 1-dimensional code shape. A thickness of the optical absorptive pattern 214 was 1 μm.

Composition of Ink D

Fine Star R181 Red (manufactured by Toyo Ink Co., Ltd.) 40 parts by mass

Fine Star R235 Yellow (manufactured by Toyo Ink Co., Ltd.) 35 parts by mass

Fine Star R31 Indigo (manufactured by Toyo Ink Co., Ltd.) 20 parts by mass

YKR-3081 (manufactured by Yamamoto Chemicals Inc.) 5 parts by mass

The label unit 210A shown in FIG. 10 and FIG. 11 represents spectrum characteristics different from each other before and after the irreversible treatment when the first wavelength of light is irradiated. Therefore, by detecting the difference of the spectrum characteristics, it is possible to obtain the same effect as that of the embodiment described above.

More specifically, when the label unit 210A was observed with the naked eye before it is subjected to the irreversible treatment, the entirety was viewed as black, and the pattern of the optical absorptive pattern layer 214 could not be recognized. Meanwhile, when the label unit 210A was observed using the reading unit 150 or a camera capable of observing in the near-infrared area, it was possible to confirm the pattern of the optical absorptive pattern layer 214, and it was possible to read the 1-dimensional code as the pattern of the optical absorptive pattern layer 214. Accordingly, as described above, when the pattern of the optical absorptive pattern layer 214 is different according to unique information in the ink cartridge 200, for example, an ink color, it is possible to specify the ink color from the reading result at the time of mounting the cartridge.

The label unit 210A was processed by the irreversible treatment in the heating unit 100 described above to heat the optical dispersion layer 212, and a part of the hollow bodies constituting the optical dispersion layer 212 was taken in the heat reception range. Thereafter, when the label unit 210A after the irreversible treatment was observed using the reading unit 150 or the camera capable of observing in the near-infrared area, an image based on the optical absorptive layer 215 was observed at the position corresponding to the area where the hollow bodies are damaged. As a result, it was difficult to observe the optical absorptive pattern layer 214, and it was difficult to read the 1-dimensional code as the optical absorptive pattern layer 214.

In the label unit 210A shown in FIG. 10 and FIG. 11, an ink E with the following composition may be used instead of the ink B described above and forming the optical functional layer 213. A film thickness and the like are as described above.

Composition of Ink E

Organic Blue Pigment (manufactured by Mikuni Color Ltd.) 5 parts by mass

Organic Red Pigment (manufactured by Mikuni Color Ltd.) 7 parts by mass

Organic Yellow Pigment (manufactured by Mikuni Color Ltd.) 8 parts by mass

Infrared Absorbing Agent (YKR-3081: manufactured by Yamamoto Chemicals, Inc.) 5 parts by mass UV Curable Offset Ink Medium (FD Carton ACE Medium B: manufactured by Toyo Ink Co., Ltd.) 75 parts by mass The optical functional layer 213 formed by the ink E includes the infrared absorbing agent that absorbs the other wavelength (the second wavelength) of light (hereinafter, referred to as the second wavelength of light) different from the first wavelength, and thus absorbs the second wavelength light. The label unit 210A having the optical functional layer 213 formed by the ink E was observed with the naked eye, the entirety is viewed as black, and it was difficult to recognize the pattern of the optical absorptive pattern layer 214. When the label unit 210A was observed using a camera provided with a band pass filter that allows only wavelengths (for example, the first wavelength) of light (the first wavelength of light) other than the second wavelength light, it was possible to confirm the pattern of the optical absorptive pattern layer 214. That is, in the label unit 210A in which the optical functional layer 213 was formed of the ink E, it was possible to read the 1-dimensional code as the pattern of the optical absorptive pattern layer 214. When the label unit 210A was observed using a camera provided with a band pass filter that allows the entire infrared area or only the wavelength band including the second wavelength to pass, it was difficult to confirm the optical absorptive pattern layer 214 due to the presence of the optical functional layer 213 having the property and state of absorbing the second wavelength light. As a result, in this condition, it was difficult to read the 1-dimensional code as the pattern of the optical absorptive pattern layer 214.

The label unit 210 obtained as described above was observed using a camera 1 provided with a band pass filter that allows the wavelength of the visible light area to pass, a camera 2 provided with a band pass filter that allows the second wavelength (850 nm) belonging to the near-infrared area to pass, and a camera 3 provided with a band pass filter that allows the first wavelength (710 nm) belonging to the near-infrared area.

Then, the irreversible treatment of the label unit 210 was performed in the same condition of Example 1. Thereafter, it was observed using the cameras 1 to 3.

Such a result thereof is shown in Table 1. In the section of "Camera 1", "Camera 2", and "Camera 3" in Table 1, "○"

means that it is possible to observe the 1-dimensional code, and "x" means that it is impossible to observe the 1-dimensional code. In the section of "Honesty Determination" in Table 1, "○" means an honest product, and "x" means a forged product which cannot be reused.

TABLE 1

| Irreversible Treatment | Camera 1 | Camera 2 | Camera 3 | Honesty Determination |
|---|---|---|---|---|
| Before | X | ○ | X | ○ |
| After | X | X | X | X |

As shown in Table 1, before the irreversible treatment, it was impossible to observe the 1-dimensional code in the camera 1 and the camera 3, but it was possible to observe the 1-dimensional code in the camera 2. Meanwhile, after the irreversible treatment, it was impossible to observe the 1-dimensional code in all the cameras 1 to 3. As described above, by detecting the difference of the spectrum characteristics of the label unit 210 before and after the irreversible treatment, it was possible to determine whether or not the label unit 210 is honest.

Figure 12:
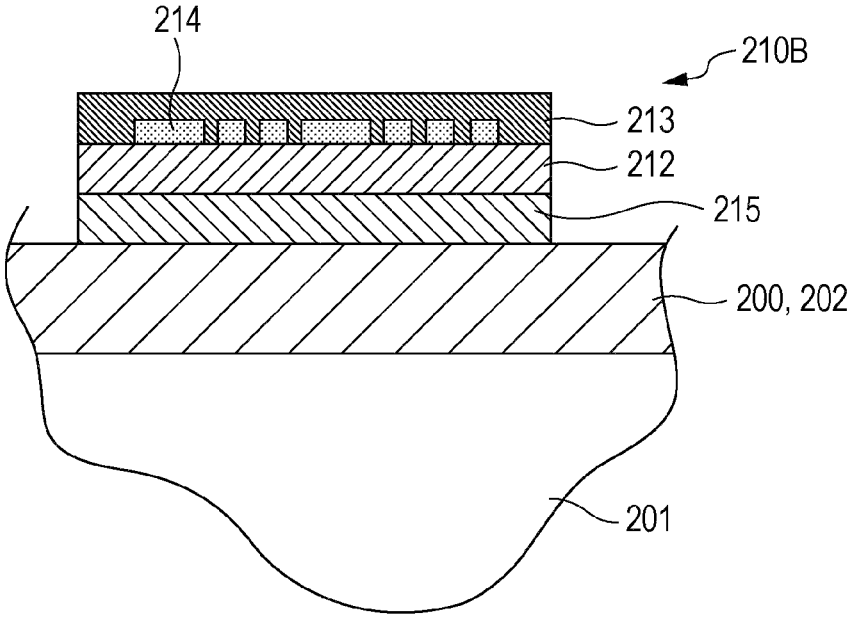
FIG. 12 is a cross-sectional view illustrating a label unit of a second modification example, corresponding to FIG. 11.

FIG. 12 corresponds to FIG. 11 and is a cross-sectional view illustrating a label unit 210B of a second modification example. As shown in FIG. 12, the label unit 210B of the modification example has the same configuration as that of the label unit 210A described with reference to FIG. 10 and FIG. 11, except that the optical absorptive pattern layer 214 is interposed between the optical functional layer 213 and the optical dispersion layer 212.

Also in the label unit 210B shown in FIG. 12, when the first wavelength of light is irradiated, the spectrum characteristics different from each other before and after the irreversible treatment described above are represented. Therefore, by detecting the difference of the spectrum characteristics, it is possible to obtain the same effect as that of the embodiment described above.

In the label unit 210B shown in FIG. 12, the optical functional layer 213 is the colored layer, particularly, the optical functional layer 213 is the black layer, and thus it is difficult to recognize the presence of the optical absorptive pattern layer 214.

Figure 13:
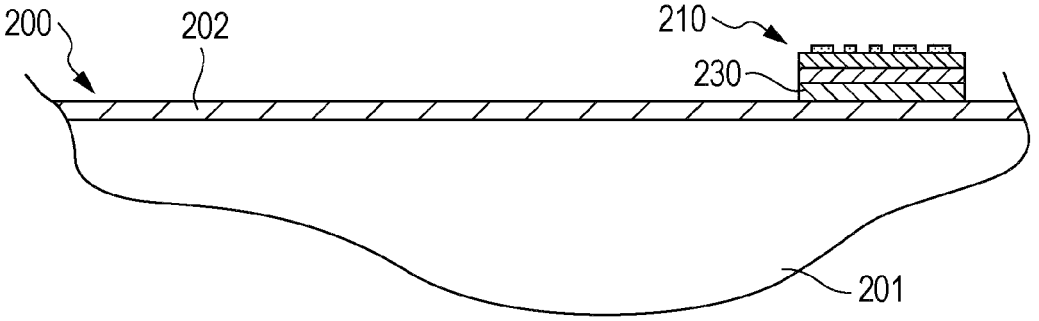
FIG. 13 is a diagram schematically illustrating another aspect of formation of the label unit.

FIG. 13 is a diagram schematically illustrating another aspect of formation of the label unit. In the aspect, an adhesive layer 230 is formed in the label unit 210 shown in FIGS. 3 to 8, and the label unit 210 is adhered onto the surface of the case 202 by the adhesive layer 230. In the forming of the adhesive layer 230, for example, a printing base formed of, for example, paper, plastic, wood, glass, or resin is prepared, and the optical dispersion layer 212 and the optical functional layer 213 are printed and formed on one face thereof in this order. The adhesive layer 230 is formed on the other face of the printing base by applying an adhesive, and the label unit 210 is adhered onto the surface of the case 202 through the adhesive layer 230. Even in such a manner, it is possible to obtain the effect described above. In this case, even when the label unit 210 subjected to the irreversible treatment by the heating unit 100 is peeled off from the ink cartridge 200 and is adhered to the other ink cartridge 200, and when the ink cartridge 200 is mounted on the carriage 30, the ink cartridge 200 can display the erroneous mounting of the ink cartridge which is used up on the display unit 72 of the operation unit 70 by the reading of the reading unit 150.

The embodiments of the invention have been described above, but the invention is not limited to the embodiments described above, and may be variously modified within a scope which does not deviate from the main concept thereof. For example, the label unit 210, the label unit 210A, and the like may be covered with a projective layer in a thin film state or a thin tissue shape having transparency of allowing light of almost the entire wavelength band to pass.

In the embodiments, in the irreversible treatment performed on the label unit 210, the label unit 210A, and the like, the heating unit 100 having the thermal head 102 is used, but the optical reflective layer 212 may be heated using a metal heater, or the optical reflective layer 212 may be irradiated with laser light or microwaves to cause the optical reflective layer 212 to generate heat such that the absorptivity of the optical reflective layer 212 is irreversibly raised by receiving the heat.

As means for deforming the hollow portions, in the embodiment, means for heating in the heating unit 100 has been described, but pressurizing means may be added in addition to heating. In this case, the hollow bodies are heated to a glass transfer temperature (80° C.), it is easy to destroy the shell of the hollow bodies by mechanical stress by pressurization, and it is possible to rapidly perform the irreversible treatment.

A part of the configuration of the embodiment may be appropriately omitted within the application scope of the invention, except for the configuration necessary to solve the problem.

What is claimed is:

1. A cartridge comprising:

an optical functional layer that allows light of a predetermined wavelength to pass;

an optical absorptive layer that absorbs the light;

an optical dispersion layer that is interposed between the optical absorptive layer and the optical functional layer and includes a hollow body dispersing the light; and wherein the optical dispersion layer irreversibly raises transmittance of the light by heat reception of the hollow body.

2. The cartridge according to claim 1, wherein the light of the wavelength is in an infrared area, and wherein the optical functional layer is a black.

3. The cartridge according to claim 2, wherein the light of the wavelength is in a near-infrared area, a transmittance of the optical functional layer to the light of the wavelength is equal to or higher than 30%, and a difference of the transmittance of the optical functional layer to light of first wavelength and to light of second wavelength is equal to or more than 10%, wherein the first wavelength is 700 to 800 nm, wherein the second wavelength is 800 to 1500 nm.

4. The cartridge according to claim 1, wherein the optical functional layer is a coloring pattern, and the optical absorptive layer is a coloring layer with the same color as that of the optical functional layer.

5. The cartridge according to claim 1, further comprising:

an optical absorptive pattern layer above the optical functional layer has a material absorbing the light of the wavelength.

6. The cartridge according to claim 5, a color of the pattern of the optical absorptive pattern layer is same as a color of the optical functional layer.

7. The cartridge according to claim 1, wherein the optical functional layer, the optical absorptive layer and the optical dispersion layer are directly formed on a case of the cartridge or are adhered onto the case.

8. A cartridge comprising:

an optical functional layer that allows light of a predetermined wavelength to pass;

an optical absorptive layer that absorbs the light;

an optical dispersion layer that is interposed between the optical absorptive layer and the optical functional layer and includes a hollow body dispersing the light; and wherein the optical dispersion layer irreversibly raises transmittance of the light by heat reception of the hollow body, wherein the optical functional layer is positioned on the incident side of the light of the wavelength.

9. A printing apparatus which is provided with the cartridge according to claim 1, comprising:

a heating unit configured to heat the optical dispersion layer.

* * * * *